US011749447B2

(12) United States Patent
Gibu

(10) Patent No.: US 11,749,447 B2
(45) Date of Patent: Sep. 5, 2023

(54) ELECTRONIC COMPONENT

(71) Applicant: Murata Manufacturing Co., Ltd., Kyoto-fu (JP)

(72) Inventor: Minoru Gibu, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 473 days.

(21) Appl. No.: 17/035,565

(22) Filed: Sep. 28, 2020

(65) Prior Publication Data

US 2021/0098185 A1 Apr. 1, 2021

(30) Foreign Application Priority Data

Sep. 30, 2019 (JP) ..... 2019-180183

(51) Int. Cl.

| | |
|---|---|
| ***H01F 27/28*** | (2006.01) |
| ***H01F 27/29*** | (2006.01) |
| ***H01F 41/061*** | (2016.01) |
| ***H01F 27/255*** | (2006.01) |

(52) U.S. Cl.

CPC ..... *H01F 27/29* (2013.01); *H01F 27/255* (2013.01); *H01F 27/2823* (2013.01); *H01F 41/061* (2016.01)

(58) Field of Classification Search

USPC ..... 336/192, 200

See application file for complete search history.

(56) References Cited

U.S. PATENT DOCUMENTS

| | | | | |
|---|---|---|---|---|
| 2016/0276089 | A1* | 9/2016 | Inoue | H01F 27/292 |
| 2018/0033540 | A1* | 2/2018 | Lee | H01F 27/292 |
| 2018/0247764 | A1* | 8/2018 | Muneuchi | B22F 3/24 |
| 2019/0326041 | A1* | 10/2019 | Kawaguchi | H01F 1/06 |

FOREIGN PATENT DOCUMENTS

| | | | | |
|---|---|---|---|---|
| CN | 107658095 | A | | 2/2018 |
| CN | 108028122 | A | | 5/2018 |
| JP | 2012104547 | A | * | 5/2012 |
| JP | 2012104547 | A | | 5/2012 |
| JP | 2016178282 | A | | 10/2016 |
| JP | 2017123433 | A | | 7/2017 |
| WO | 2017135057 | A1 | | 8/2017 |

* cited by examiner

*Primary Examiner* — Shawki S Ismail
*Assistant Examiner* — Kazi S Hossain
(74) *Attorney, Agent, or Firm* — Studebaker & Brackett PC

(57) ABSTRACT

An electronic component including an element body having a magnetic body; an internal electrode embedded in the element body and whose end portion is exposed from an end surface of the element body; and an external electrode on an outer surface of the element body. The external electrode has a bottom surface portion on a bottom surface of the element body, and an end surface portion extending to an end surface of the element body that intersects perpendicularly with the bottom surface. The end surface portion is connected to the internal electrode exposed from the end surface. The bottom surface portion includes a first bottom surface portion arranged on the element body side, and a second bottom surface portion arranged on an outer side of the first bottom surface portion. The first bottom surface portion is a resin electrode containing a resin and a conductive filler.

20 Claims, 4 Drawing Sheets

ELECTRONIC COMPONENT

CROSS-REFERENCE TO RELATED APPLICATION

This application claims benefit of priority to Japanese Patent Application No. 2019-180183, filed Sep. 30, 2019, the entire content of which is incorporated herein by reference.

BACKGROUND

Technical Field

The present disclosure relates to an electronic component.

Background Art

As an electronic component such as an inductor, in Japanese Patent Application Laid-Open No. 2012-104547, there is a disclosure of an electronic component having a rectangular parallelepiped-shaped or cubic-shaped outer shape, in which an external electrode having an L-shaped cross section that continuously covers a part of an end surface and a part of a bottom surface that are adjacent to each other with a corner portion interposed therebetween is provided on each of end surfaces facing each other, and in which the surface roughness Ra of the end surface covered by the external electrode is 0.5 μm or more.

Further, in Japanese Patent Application Laid-Open No. 2012-104547, there is a disclosure of a method of manufacturing an electronic component, including a step of preparing a green laminated ceramic substrate having a predetermined element structure formed therein; a step of forming a plurality of grooves each having an inner side surface roughened on one surface of the green laminated ceramic substrate in parallel to each other at a predetermined interval; a step of filling each of the grooves with an external electrode material; a step of forming a plurality of electrode patterns extending along the respective grooves so as to cover surfaces of the external electrode material filled in the grooves; a step of cutting the green laminated ceramic substrate along the respective grooves to make the green laminated ceramic substrate into chips; and a step of firing ceramic chips obtained by making the green laminated ceramic substrates into chips.

SUMMARY

In the electronic component described in Japanese Patent Application Laid-Open No. 2012-104547, each end surface of an element body is provided with a conductor paste (external electrode material) that serves as an end surface portion of the external electrode, and a bottom surface of the element body is provided with an electrode pattern that serves as a bottom surface portion of the external electrode. The interface between the element body and the external electrode is roughened by roughening the inner side surface of each of the grooves formed in the green laminated ceramic substrate during the production of the electronic component. Thereby, high close-contact strength can be obtained between the element body and the end surface portion of the external electrode.

On the other hand, since the bottom surface of the element body is not roughened, the close-contact strength between the element body and the bottom surface portion of the external electrode is not sufficient. By roughening the bottom surface of the element body, it is possible to improve the close-contact strength between the element body and the bottom surface portion of the external electrode, but a trouble such as air entrapment occurs on the bottom surface portion of the external electrode at the time of mounting on a mounting board, so that the mountability may decrease.

Accordingly, the present disclosure provides an electronic component having high close-contact strength between an element body and a bottom surface portion of an external electrode and excellent mountability.

According to the present disclosure, there is provided an electronic component including an element body having a magnetic body; an internal electrode which is embedded in the element body and whose end portion is exposed from an end surface of the element body; and an external electrode provided on an outer surface of the element body. The external electrode has a bottom surface portion arranged on a bottom surface of the element body, and an end surface portion arranged so as to extend to an end surface of the element body that intersects perpendicularly with the bottom surface of the element body. The end surface portion is connected to the internal electrode exposed from the end surface of the element body. the bottom surface portion includes a first bottom surface portion arranged on the element body side, and a second bottom surface portion arranged on an outer side of the first bottom surface portion. The first bottom surface portion is a resin electrode containing a resin and a conductive filler.

According to the present disclosure, it is possible to provide the electronic component having high close-contact strength between the element body and the bottom surface portion of the external electrode and excellent mountability.

DETAILED DESCRIPTION

Hereinafter, an electronic component of the present disclosure will be described. The present disclosure is not limited to the following configurations, and may be modified as appropriate without departing from the gist of the present disclosure. Further, a combination of a plurality of individual preferable configurations described below is also the present disclosure.

As an embodiment of the electronic component of the present disclosure, a coil component whose internal electrode is a coil conductor will be described as an example. The present disclosure is not limited to a coil component, but can be applied to various electronic components such as an inductor that does not include a coil conductor as an internal electrode.

Figure 1:
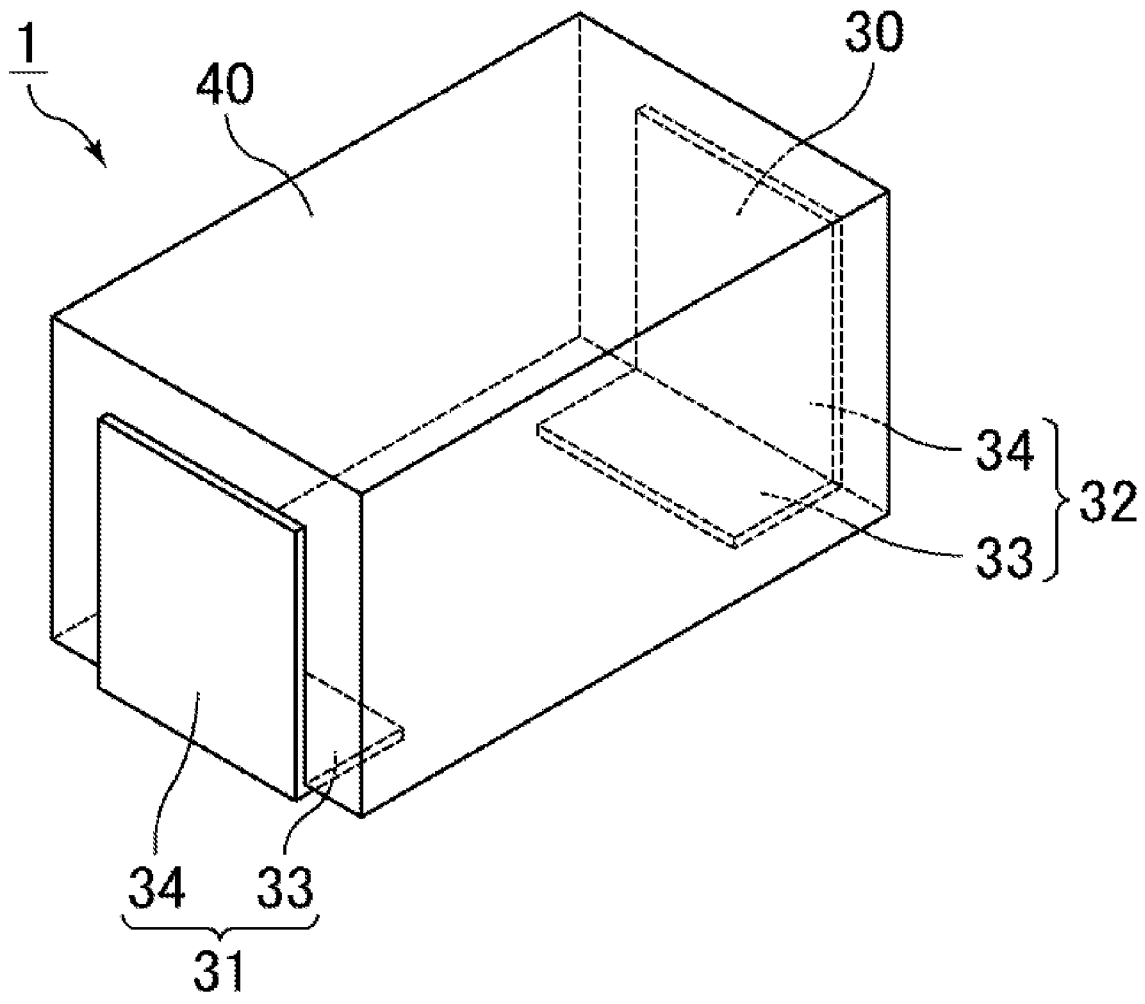
FIG. 1 is a perspective view schematically showing an example of a coil component of the present disclosure.
Figure 2:
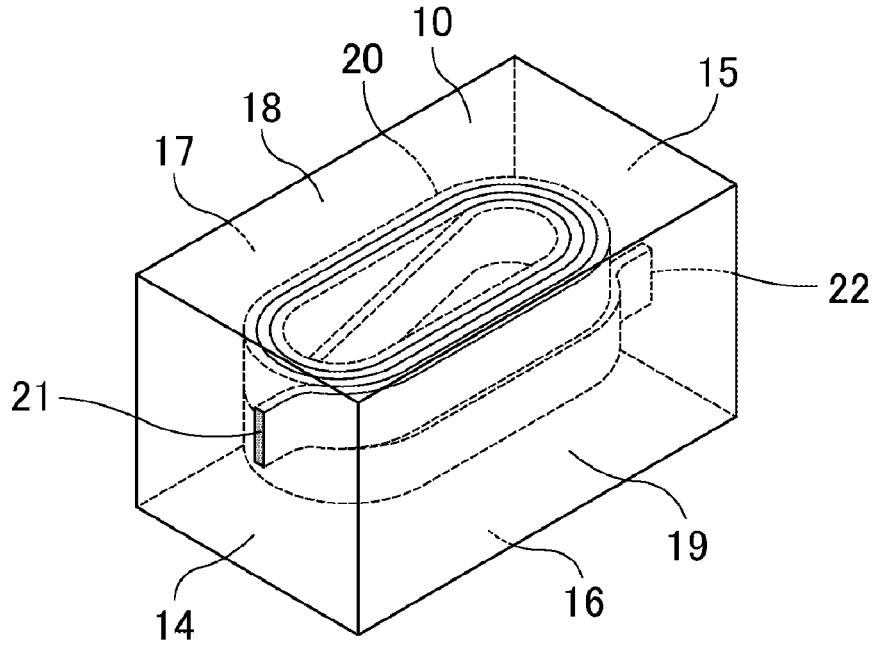
FIG. 2 is a perspective view in which a part of the coil component shown in FIG. 1 is omitted.
Figure 3:
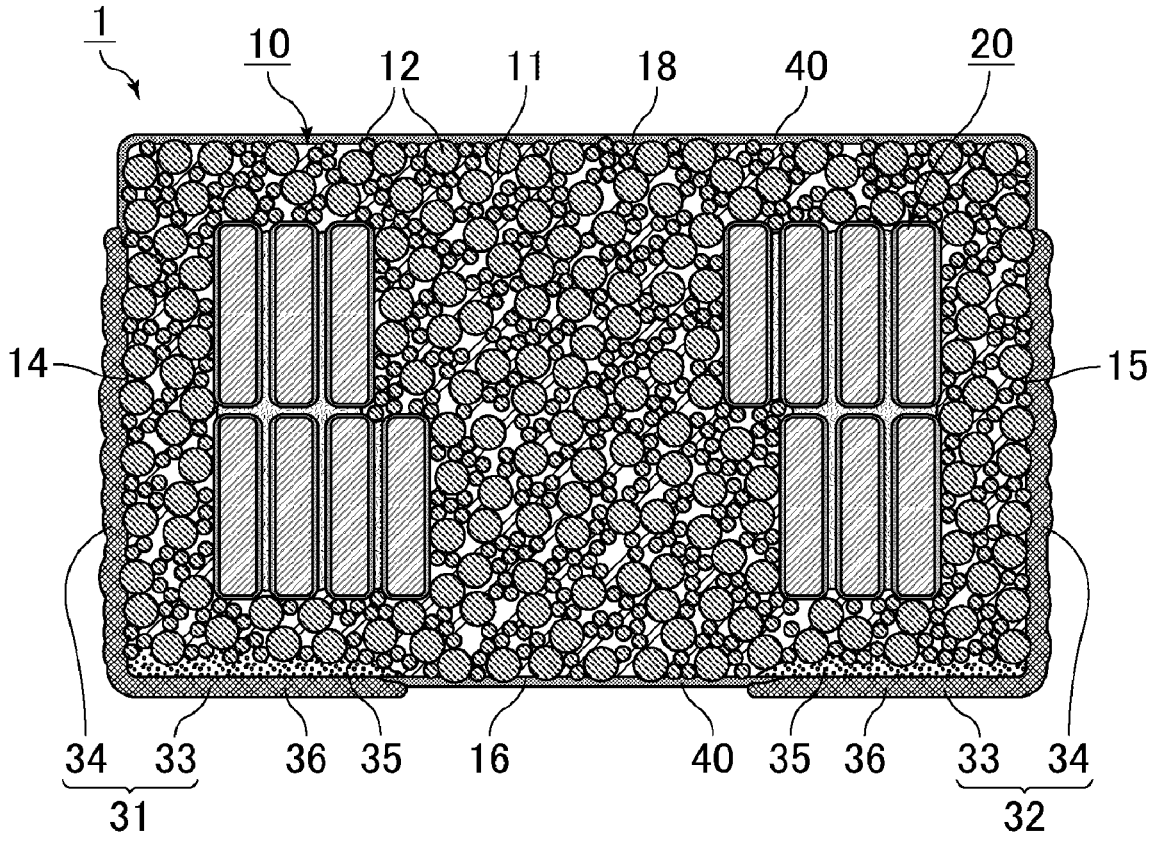
FIG. 3 is a sectional view of the coil component shown in FIG. 1.

FIG. 1 is a perspective view schematically showing an example of the coil component of the present disclosure. FIG. 2 is a perspective view in which a part of the structure of the coil component shown in FIG. 1 is omitted. FIG. 3 is a sectional view of the coil component shown in FIG. 1.

As shown in FIGS. 1, 2 and 3, a coil component 1 includes an element body 10 having a magnetic body, a coil conductor 20 embedded in the element body 10, a first external electrode 31 and a second external electrode 32 provided on an outer surface of the element body 10 and electrically connected to the coil conductor 20, and an insulating film 40 provided on the outer surface of the element body 10. The insulating film 40 may not be provided on the outer surface of the element body 10.

The element body 10 has, for example, a rectangular parallelepiped shape. The element body 10 has a first end surface 14 and a second end surface 15 facing each other, a bottom surface 16 between the first end surface 14 and the second end surface 15, a first side surface 17, a top surface 18, and a second side surface 19. The bottom surface 16, the first side surface 17, the top surface 18, and the second side surface 19 are arranged in order in the circumferential direction. The bottom surface 16 serves as a mounting surface at the time of mounting the coil component 1. The top surface 18 faces the bottom surface 16. The first side surface 17 and the second side surface 19 face each other. The first end surface 14, the second end surface 15, the first side surface 17, and the second side surface 19 intersect perpendicularly with the bottom surface 16.

In the coil conductor 20, a first end portion 21 on one side is exposed from the first end surface 14 of the element body 10, and a second end portion 22 on the other side is exposed from the second end surface 15 of the element body 10.

The first external electrode 31 is provided on the first end surface 14 side of the element body 10. The first external electrode 31 is provided continuously on the first end surface 14 of the element body 10 and the bottom surface 16 on the first end surface 14 side. Therefore, the first external electrode 31 has a bottom surface portion 33 arranged on the bottom surface 16 of the element body 10 and an end surface portion 34 arranged so as to extend to the first end surface 14 of the element body 10. Thus, the first external electrode 31 is preferably formed in an L shape.

The second external electrode 32 is provided on the second end surface 15 side of the element body 10. The second external electrode 32 is provided continuously on the second end surface 15 of the element body 10 and the bottom surface 16 on the second end surface 15 side. Therefore, the second external electrode 32 has a bottom surface portion 33 arranged on the bottom surface 16 of the element body 10 and an end surface portion 34 arranged so as to extend to the second end surface 15 of the element body 10. Thus, the second external electrode 32 is preferably formed in an L shape.

Figure 5:
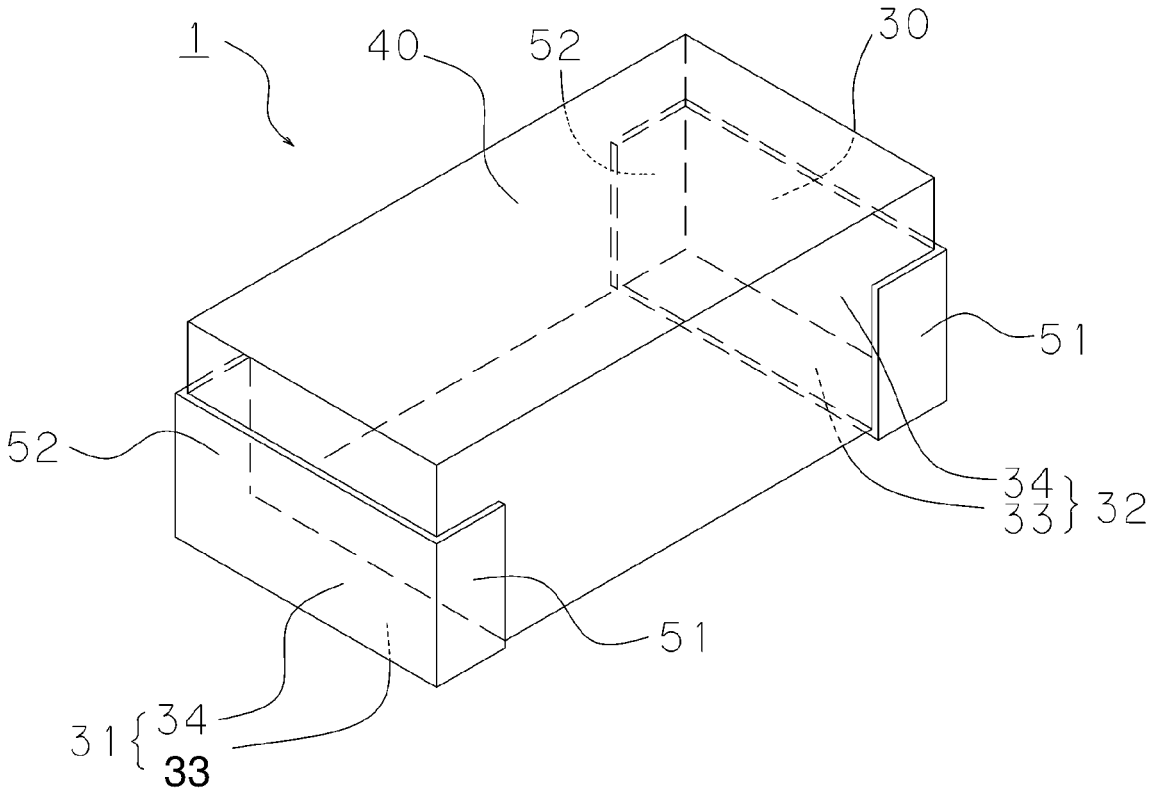
FIG. 5 is a perspective view schematically showing an example of a coil component of the present disclosure.

The first external electrode 31 may be provided continuously on the first end surface 14, the bottom surface 16, the first side surface 17, and the second side surface 19 of the element body 10 as shown in FIG. 5. In this case, the first external electrode 31 includes, in addition to the bottom surface portion 33 and the end surface portion 34, a first side surface portion 51 arranged so as to extend to the first side surface 17 of the element body 10, and a second side surface portion 52 arranged so as to extend to the second side surface 19 of the element body 10. Similarly, the second external electrode 32 may be provided continuously on the second end surface 15, the bottom surface 16, the first side surface 17, and the second side surface 19 of the element body 10. In this case, the second external electrode 32 includes, in addition to the bottom surface portion 33 and the end surface portion 34, a first side surface portion 51 arranged so as to extend to the first side surface 17 of the element body 10, and a second side surface portion 52 arranged so as to extend to the second side surface 19 of the element body 10. When the first external electrode 31 or the second external electrode 32 has the first side surface portion 51 and the second side surface portion 52, the first side surface portion 51 is preferably connected to the bottom surface portion 33 and the end surface portion 34, and the second side surface portion 52 is preferably connected to the bottom surface portion 33 and the end surface portion 34.

The end surface portion 34 of the first external electrode 31 is connected to the coil conductor 20 exposed from the first end surface 14 of the element body 10. Therefore, the first external electrode 31 is electrically connected to the first end portion 21 of the coil conductor 20. Similarly, the end surface portion 34 of the second external electrode 32 is connected to the coil conductor 20 exposed from the second end surface 15 of the element body 10. Therefore, the second external electrode 32 is electrically connected to the second end portion 22 of the coil conductor 20.

As shown in FIG. 3, in the first external electrode 31, the bottom surface portion 33 includes a first bottom surface portion 35 arranged on the element body 10 side and a second bottom surface portion 36 arranged on an outer side of the first bottom surface portion 35. Similarly, in the second external electrode 32, the bottom surface portion 33 includes a first bottom surface portion 35 arranged on the element body 10 side and a second bottom surface portion 36 arranged on an outer side of the first bottom surface portion 35.

Figure 4:
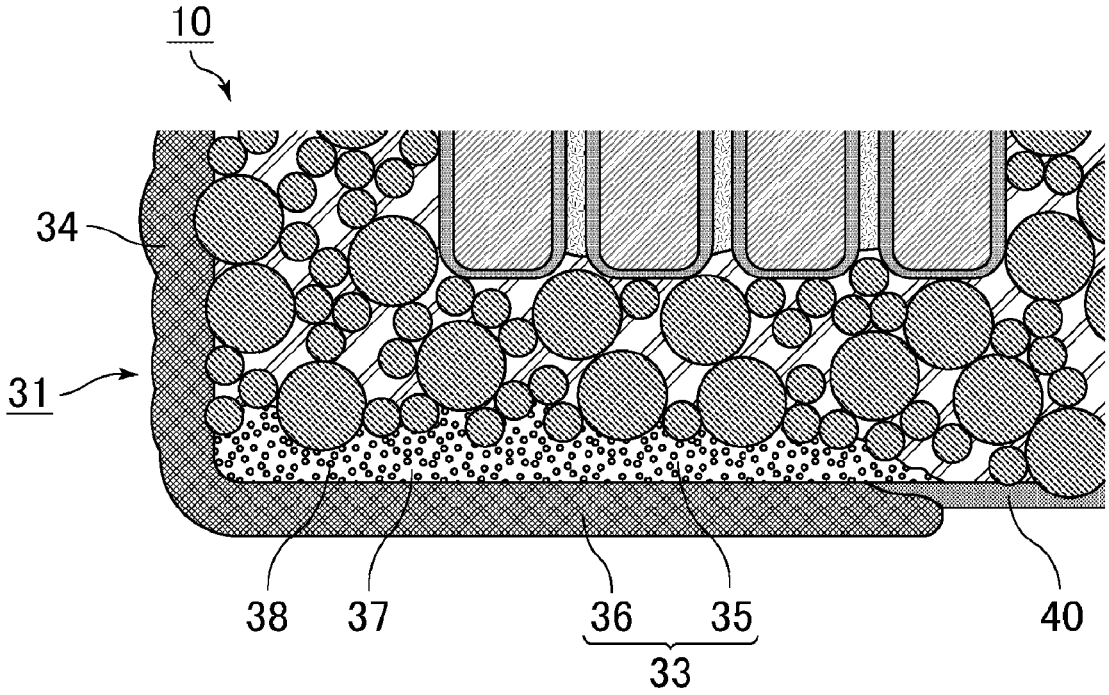
FIG. 4 is an enlarged sectional view of the vicinity of a bottom surface portion of a first external electrode.

FIG. 4 is an enlarged sectional view of the vicinity of the bottom surface portion of the first external electrode.

The first bottom surface portion 35 is a resin electrode containing a resin 37 and a conductive filler 38.

The first bottom surface portion 35, which is the resin electrode, is held in contact with the element body 10 so as to bite into it. Therefore, the close-contact strength between the element body 10 and the bottom surface portion 33 of the external electrode 31 or 32 can be improved. Meanwhile, by arranging the first bottom surface portion 35, which is the resin electrode, between the element body 10 and the second bottom surface portion 36, the second bottom surface portion 36 can be flattened. Therefore, air entrapment or the like which may be generated on the bottom surface portion 33 of the external electrode 31 or 32 at the time of mounting on a mounting board is relaxed, and mountability such as solder wettability and loadability can be improved.

Further, due to the toughness of the resin electrode, the stress applied to the bottom surface portion 33 of the external electrode 31 or 32 is relaxed. Further, the resin electrode relaxes the difference in linear expansion between the element body 10 and the bottom surface portion 33 of the external electrode 31 or 32.

Note that, in either one of the first external electrode 31 and the second external electrode 32, the bottom surface portion 33 may include the first bottom surface portion 35 and the second bottom surface portion 36, but in each of the first external electrode 31 and the second external electrode 32, the bottom surface portion 33 preferably includes the first bottom surface portion 35 and the second bottom surface portion 36.

The surface roughness of the first bottom surface portion 35 on the second bottom surface portion 36 side is preferably smaller than the surface roughness of the first bottom surface portion 35 on the element body 10 side. This makes it possible to easily achieve both the "close-contact strength" and the "flattening".

The surface roughness of the first bottom surface portion 35 on the second bottom surface portion 36 side is preferably smaller than the surface roughness of the end surface 14 or 15 of the element body 10. Thereby, the surface roughness Ra of the bottom surface portion 33 of the external electrode 31 or 32 can be easily made smaller than the surface roughness Ra of the end surface portion 34 of the external electrode 31 or 32.

The resin electrode contains the resin 37 and the conductive filler 38, preferably a thermosetting resin and a metal filler. By using the resin, the mechanical strength against deflection, bending, dropping, vibration, impact, etc. is improved.

Examples of the thermosetting resin include an epoxy resin, a phenol resin, an acrylic resin, and the like. By using these thermosetting resins, suitable linear expansion and curing temperature can be selected.

Examples of the element forming the metal filler include Cu, Ag, and the like. The element may be a combination of these. By using these metal fillers, the difference in resistivity with the external electrode can be reduced.

The metal filler is preferably bonded to the second bottom surface portion by metal bonding. In this case, the close-contact strength increases and the fixing force increases.

The second bottom surface portion 36 is preferably a plating electrode formed by plating. Since the second bottom surface portion 36 can be formed thin by plating, the characteristics can be improved by increasing the size of the element body 10. Examples of the metal material forming the plating electrode include Cu, Ni, Sn, and the like.

The second bottom surface portion 36 may be formed by a plurality of layers. By using the plurality of layers, the corrosion resistance, heat resistance, and strength can be improved.

The end surface portion 34 is preferably a plating electrode formed by plating. Since the end surface portion 34 can be formed thin by plating, the characteristics can be improved by increasing the size of the element body 10. Examples of the metal material forming the plating electrode include Cu, Ni, Sn, and the like.

The end surface portion 34 and the second bottom surface portion 36 are preferably made of the same material. If the end surface portion 34 and the second bottom surface portion 36 are made of the same material, the connectivity between them becomes favorable, and the fixing force increases. The end surface portion 34 may be formed by a plurality of layers.

The end surface portion 34 is preferably held in direct contact with the element body 10. The end surface portion 34 is held in direct contact with the element body 10, so that the close-contact strength between the end surface portion 34 and the element body 10 can be increased.

Furthermore, when the first external electrode 31 or the second external electrode 32 has the above-mentioned first side surface portion and second side surface portion, the first side surface portion and the second side surface portion are preferably plating electrodes formed by plating. The end surface portion 34, the second bottom surface portion 36, the first side surface portion, and the second side surface portion are preferably made of the same material. The first side surface portion and the second side surface portion may be formed by a plurality of layers. Further, the first side surface portion and the second side surface portion are preferably held in direct contact with the element body 10.

In the first external electrode 31 or the second external electrode 32, when the bottom surface portion 33 includes the first bottom surface portion 35 and the second bottom surface portion 36, the surface roughness Ra of the bottom surface portion 33 is preferably smaller than the surface roughness Ra of the end surface portion 34. By roughening the surface of the end surface portion 34, an anchor effect is exerted between the end surface portion 34 and the element body 10, so that the close-contact strength between the end surface portion 34 and the element body 10 can be increased.

When the surface roughness Ra of the bottom surface portion 33 is smaller than the surface roughness Ra of the end surface portion 34, the surface of the first bottom surface portion 35 is preferably flush with the bottom surface of the element body 10. In this case, the surface roughness Ra of the bottom surface portion 33 can be reduced. Note that, the term "flush" does not require that the surface of the first bottom surface portion 35 is strictly flush with the bottom surface of the element body 10, and for example, the surface of the first bottom surface portion 35 may be displaced by about 0.05 μm from the bottom surface of the element body 10.

Considering the mountability, the surface roughness Ra of the bottom surface portion 33 is preferably less than 1 μm. In this case, the surface roughness Ra of the bottom surface portion 33 is preferably 0.05 μm or more. Further, the surface roughness Ra of the bottom surface portion 33 may be 1 μm or more and 5 μm or less. When the surface roughness Ra of the bottom surface portion 33 is in the above range, air entrapment or the like is less likely to occur during mounting, and tombstones are less likely to occur. In the first external electrode 31 and the second external electrode 32, the surface roughness Ra of the bottom surface portion 33 may be the same or different.

Considering the anchor effect between the end surface portion 34 and the element body 10, the surface roughness Ra of the end surface portion 34 is preferably 6 μm or more. When the surface roughness Ra of the end surface portion 34 is in the above range, the anchor effect can be increased. Meanwhile, the surface roughness Ra of the end surface portion 34 is preferably 10 μm or less. In the first external electrode 31 and the second external electrode 32, the surface roughness Ra of the end surface portion 34 may be the same or different.

Furthermore, when the first external electrode 31 or the second external electrode 32 has the above-mentioned first side surface portion and second side surface portion, the surface roughness Ra of the bottom surface portion 33 is preferably smaller than the surface roughness Ra of the first side surface portion and the second side surface portion. Thereby, the close-contact strength between the element body 10 and the external electrode 31 or 32 can be further improved. The preferable range of the surface roughness Ra of the first side surface portion and the second side surface portion is the same as the preferable range of the surface roughness Ra of the end surface portion 34. The surface roughness Ra of the first side surface portion and the surface roughness Ra of the second side surface portion may be the same or different. Further, in the first external electrode 31 and the second external electrode 32, the surface roughness Ra of the first side surface portion and the second side surface portion may be the same or different.

In the present specification, the surface roughness Ra is the arithmetic average roughness Ra defined by JIS B 0601:2001. The surface roughness is measured using a non-contact shape measuring instrument (VK-X200 manufactured by KEYENCE CORPORATION) with a cutoff value λc of 0.8 μm.

As shown in FIG. 3, the magnetic body forming the element body 10 preferably contains a resin 11 and metal magnetic grains 12. By using the resin, the mechanical strength against deflection, bending, dropping, vibration, impact, etc. is improved.

Examples of the resin 11 include thermosetting resins such as a polyimide resin and an epoxy resin.

The metal forming the metal magnetic grains 12 may be, for example, Fe, an alloy containing Fe such as FeSiCr, or both Fe and an alloy containing Fe. The metal magnetic grains 12 may contain at least one metal of Pd, Ag, and Cu in addition to Fe or an alloy of Fe. These metals function as a plating catalyst that improves the growth rate of the plating when the element body is plated. The surface of the metal magnetic grains 12 may be covered with an insulating film.

The metal magnetic grains 12 are preferably bonded to the end surface portion 34 by metal bonding. In this case, the close-contact strength increases and the fixing force increases.

The coil conductor 20 includes a conductive material such as Au, Ag, Cu, Pd, or Ni. The surface of the conductive material may be covered with an insulating film.

The coil conductor 20 is wound around the winding axis. The direction of the winding axis is preferably perpendicular to the bottom surface 16 of the element body 10 as shown in FIG. 2. In this case, since it is not necessary to secure an extra space for drawing out the coil conductor 20 to the first end surface 14 or the second end surface 15 of the element body 10, it is possible to improve the characteristics by increasing the size of the coil conductor 20 with respect to the element body 10.

In FIG. 2, the coil conductor 20 is formed by spirally winding in two stages so that the first end portion 21 and the second end portion 22 are located on the outer circumference. That is, the coil conductor 20 is formed by winding a flat conductor wire in a winding (outer winding). However, the shape of the coil conductor 20 is not particularly limited, and the winding method of the coil conductor 20 is not particularly limited.

When the coil component 1 includes the insulating film 40, a portion of the outer surface of the element body 10 where the first external electrode 31 and the second external electrode 32 are not provided is covered with the insulating film 40. That is, the coil component 1 includes the first external electrode 31 and the second external electrode 32 provided on a part of the outer surface of the element body 10, and the insulating film 40 provided on the other part of the outer surface. When the insulating film 40 is provided on the portion of the outer surface of the element body 10 where the first external electrode 31 and the second external electrode 32 are not provided, it is possible to suppress the plating from growing greatly beyond the contact region during plating, so that the breakdown voltage can be improved.

A part of the insulating film 40 and a part of the first external electrode 31 or the second external electrode 32 may overlap each other. For example, as shown in FIG. 4, the insulating film 40 may overlap the edge portion of the first bottom surface portion 35. In this case, the peel strength of the first bottom surface portion 35 can be increased.

The insulating film 40 is made of a resin material having high electric insulation such as an acrylic resin, an epoxy resin, or a polyimide resin.

The coil component 1 is manufactured, for example, as follows.

First, the coil conductor 20 is provided inside the element body 10. As one of the methods for embedding the coil conductor 20 in the element body 10 containing the resin 11 and the metal magnetic grains 12, there is giving a method of aligning a plurality of winding coils, collectively embedding the winding coils in a sheet containing metal magnetic powder, curing them, and then separating them into individual pieces by dicing cutting or the like (for example, refer to Japanese Patent Application Laid-Open No. 2017-123433). In this method, one surfaces of the wound coils are collectively embedded and cured, and then the other surfaces are embedded to form a chip inductor.

For example, one surface of the coil conductor 20 is embedded in a sheet, and then the other surface of the coil conductor 20 is coated with Ag resin paste by screen printing and dried to form resin electrodes. This resin electrodes serve as the first bottom surface portions 35 of the first external electrode 31 and the second external electrode 32. As a result, the first bottom surface portions 35 and the element body 10 are held in direct contact with each other. After the other surface of the coil conductor 20 on which the first bottom surface portions 35 are formed is embedded in a sheet, the coil conductor 20 and the sheets are pressed and cured to form a mother cured product.

Subsequently, the mother cured product is cut by a dicer and separated into individual pieces, so that the coil conductor 20 is exposed on the first end surface 14 and the second end surface 15 of the element body 10. The insulating film 40 is preferably formed on the outer surface of the element body 10 through a barrel polishing step. The insulating film 40 may cover the edge portion of the first bottom surface portion 35, which is the resin electrode. For example, in the method described in Japanese Patent Application Laid-Open No. 2016-178282, the insulating film 40 is formed with the metal magnetic grains 12 of the element body 10 as a core. In FIG. 4, the insulating film 40 and the edge portion of the first bottom surface portion 35 are held in direct contact with each other.

The insulating film 40 on the first end surface 14 and the second end surface 15 of the element body 10 is peeled off by a laser to expose the metal magnetic grains 12 (see, for example, International Publication No. 2017/135057). As a result, bases of the end surface portion 34 and the second bottom surface portion 36 of each of the first external electrode 31 and the second external electrode 32 are formed. After that, the end surface portion 34 and the second bottom surface portion 36 are formed by electrolytic plating. As a result, at the first end surface 14 and the second end surface 15 of the element body 10, the element body 10 and the coil conductor 20 are held in direct contact with the end surface portions 34, which are the plating electrodes. With the above method, the surface roughness Ra of the end surface portion 34 can be set to 6 μm or more. Further, the second bottom surface portion 36 and the end surface portion 34 of each of the first external electrode 31 and the second external electrode 32 are integrally formed in an L shape by the plating electrode.

From the above, the coil component 1 is obtained.

In the above method, the other surface of the coil conductor 20 is embedded in the sheet after the resin electrodes that serve as the first bottom surface portions 35 are formed. Therefore, the surface roughness Ra of the bottom surface portion 33 can be less than 1 μm. Meanwhile, the resin electrodes that serve as the first bottom surface portions 35 may be formed after the other surface of the coil conductor 20 is embedded in the sheet. In this case, the printing surface of the Ag resin paste is not pressed. Therefore, the surface roughness Ra of the bottom surface portion 33 can be set to 1 μm or more and 5 μm or less (i.e., from 1 μm to 5 μm). In any case, the first bottom surface portion 35, which is the resin electrode, is held in contact with the element body 10 so as to bite into the element body 10.

The electronic component of the present disclosure is not limited to the above embodiment, and various applications and modifications can be made to the configurations of electronic components of the coil component or the like, manufacturing conditions, and the like within the scope of the present disclosure.

What is claimed is:

1. An electronic component comprising:

an element body having a magnetic body;

an internal electrode which is embedded in the element body and whose end portion is exposed from an end surface of the element body; and an external electrode provided on an outer surface of the element body, the external electrode having a bottom surface portion arranged on a bottom surface of the element body, and an end surface portion arranged so as to extend to an end surface of the element body that intersects perpendicularly with the bottom surface of the element body, the end surface portion of the external electrode being connected to the internal electrode exposed from the end surface of the element body, the bottom surface portion of the external electrode including a first bottom surface portion arranged on the element body side, and a second bottom surface portion arranged on an outer side of the first bottom surface portion, and the first bottom surface portion being a resin electrode containing a resin and a conductive filler, wherein the end surface portion of the external electrode does not include a resin electrode containing a resin and a conductive filler along the entire end surface portion.

2. The electronic component according to claim 1, wherein the internal electrode is a coil conductor wound around a winding axis, and a direction of the winding axis is perpendicular to the bottom surface of the element body.

3. The electronic component according to claim 1, wherein the magnetic body forming the element body contains a resin and metal magnetic grains.

4. The electronic component according to claim 3, wherein the metal magnetic grains are bonded to the end surface portion of the external electrode by metal bonding.

5. The electronic component according to claim 1, wherein the resin electrode contains a thermosetting resin and a metal filler.

6. The electronic component according to claim 5, wherein the thermosetting resin is an epoxy resin, a phenol resin, or an acrylic resin.

7. The electronic component according to claim 5, wherein an element of the metal filler is Cu, Ag, or a combination thereof.

8. The electronic component according to claim 5, wherein the metal filler is bonded to the second bottom surface portion by metal bonding.

9. The electronic component according to claim 1, wherein the end surface portion of the external electrode is in direct contact with the element body.

10. The electronic component according to claim 1, wherein the second bottom surface portion includes a plurality of layers.

11. The electronic component according to claim 1, wherein a surface roughness Ra of the bottom surface portion of the external electrode is smaller than a surface roughness Ra of the end surface portion of the external electrode.

12. The electronic component according to claim 11, wherein the surface roughness Ra of the end surface portion of the external electrode is 6 μm or greater.

13. The electronic component according to claim 11, wherein the surface roughness Ra of the bottom surface portion of the external electrode is from 1 μm to 5 μm.

14. The electronic component according to claim 11, wherein the surface roughness Ra of the bottom surface portion of the external electrode is less than 1 μm.

15. The electronic component according to claim 11, wherein a surface of the first bottom surface portion is flush with the bottom surface of the element body.

16. The electronic component according to claim 1, wherein in addition to the bottom surface portion and the end surface portion, the external electrode further includes a first side surface portion arranged so as to extend to a first side surface of the element body that intersects perpendicularly with the bottom surface and the end surface of the element body, and a second side surface portion arranged so as to extend to a second side surface of the element body that intersects perpendicularly with the bottom surface and the end surface of the element body and faces the first side surface, and the surface roughness Ra of the bottom surface portion is smaller than a surface roughness Ra of the first side surface portion and the second side surface portion.

17. The electronic component according to claim 1, wherein the end surface portion of the external electrode is a plating electrode.

18. The electronic component according to claim 1, wherein the end surface portion and the second bottom surface portion are made of the same material.

19. The electronic component according to claim 1, wherein a portion of the outer surface of the element body where the external electrode is not provided is covered with an insulating film.

20. The electronic component according to claim 19, wherein the insulating film overlaps an edge portion of the first bottom surface portion.

* * * * *